United States Patent [19]

Stern et al.

[11] Patent Number: 4,843,357

[45] Date of Patent: Jun. 27, 1989

[54] TETRAHEDRAL JUNCTION WAVEGUIDE SWITCH

[75] Inventors: Richard A. Stern, Allenwood; Herbert A. Leupold, Eatontown, both of N.J.

[73] Assignee: The United States of America as represented by the Secretary of the Army, Washington, D.C.

[21] Appl. No.: 260,550

[22] Filed: Oct. 20, 1988

[51] Int. Cl.[4] ..... H01P 1/11

[52] U.S. Cl. ..... 333/258; 333/102; 335/304

[58] Field of Search ..... 333/102, 258; 335/301, 335/304, 306

[56] References Cited

U.S. PATENT DOCUMENTS

| | | | |
|---|---|---|---|
| 2,719,274 | 9/1955 | Luhrs . | |
| 3,038,131 | 6/1952 | Uebele et al. | 333/102 |
| 4,647,887 | 3/1987 | Leupold | 335/211 |
| 4,654,618 | 3/1987 | Leupold | 335/304 |

OTHER PUBLICATIONS

IRE Transactions on Microwave Theory and Techniques, pp. 120–121, Jan. 1960.

A Fast Ferrite Switch for Use at 70 KMC, IRE Trans. on MTT pp. 300–303, Jul. 1958, E. H. Turner.

Tech Rpt Ecom-3264, "A Fast 3-Millimeter Ferrite Switch", dtd. Apr. 1970 by Richard A. Stern.

*Primary Examiner*—Paul Gensler

*Attorney, Agent, or Firm*—Sheldon Kanars; Robert A. Maikis

[57] ABSTRACT

A tetrahedral junction waveguide switch is provided having two axially juxtaposed sections of hollow rectangular waveguide which are mutually cross-polarized by being rotated 90 degrees with respect to each other. A rod of a ferrite material having gyromagnetic properties is axially disposed within the juxtaposed ends of the waveguide sections and is selectively axially magnetized to control transmission of RF electromagnetic wave energy through the sections. A permanent magnet structure having a unique cladding arrangement which minimizes flux leakage and produces a magnet of high coercive force is employed to produce a unidirectional magnetic bias field along the longitudinal axis of the rod to keep the switch in a low loss transmission state by virtue of Reggia-Spencer effect signal rotation. A selectively operable helical coil is utilized to produce another axial magnetic field which nullifies the bias magnetic field when it is desired to place the switch in a high loss or cut-off transmission state.

7 Claims, 3 Drawing Sheets

TETRAHEDRAL JUNCTION WAVEGUIDE SWITCH

STATEMENT OF GOVERNMENT RIGHTS

The invention described herein may be manufactured, used and licensed by or for the Government of governmental purposes without the payment to us of any royalties thereon.

BACKGROUND OF THE INVENTION

1. Field of the Invention

This invention relates to the field of hollow, metallic waveguide transmission line components operating in the millimeter wave region of the frequency spectrum and more particularly to an improved tetrahedral junction type of waveguide switch which is especially suited for use in millimeter wave applications, such as radar equipment and the like, for example.

2. Description of the Prior Art

Tetrahedral junction waveguide switches are used in many millimeter wave applications employing the hollow, metallic waveguide transmission medium to modulate or control the flow of electromagnetic wave energy through the waveguides. This type of switch basically comprises two lengths of hollow, metallic waveguide which are axially aligned with each other along their longitudinal axes. Each waveguide length has a reduced width end which is rotated 90 degrees with respect to the reduced width end of the other waveguide length and the reduced width ends are juxtaposed so that the lengths are mutually cross-polarized with respect to signal transmission through the aperture formed by the juxtaposed ends of the waveguide lengths. A rod of a ferrite material having gyromagnetic properties is disposed in the aperture and aligned with the longitudinal axes of the waveguide lengths. The rod has tapered ends which cooperate with the orthogonally disposed reduced width ends of the waveguide lengths to load or terminate the waveguide lengths and thereby to cut-off signal transmission through the aperture. However, when the ferrite rod is subjected to a unidirectional magnetic field along its longitudinal axis, the permeability of the rod is changed and the signal applied to the switch is rotated 90 degrees in accordance with the well-known Reggia-Spencer effect so that the signal is permitted to pass through the aperture. Accordingly, by controlling the magnetization of the ferrite rod, the switch may be placed in either the cut-off or transmission states.

When tetrahedral junction waveguide switches are used as crystal protectors for millimeter wave radar receivers, they must protect the receiver during the duration of the radar transmitter pulse and must therefor be in the cut-off or "reflective" state. When the radar echo signal is received, they must be in the transmission state. The time required to operate the switch from the cut-off state to the transmission state should be kept as short as possible so as not to significantly reduce the minimum range of the radar. In order to minimize the drain on the dc power supply of the radar system, a permanent magnet structure is employed to magnetically bias the ferrite rod into the switch transmission state. An electromagnetic coil arrangement is then employed to induce a counter balancing magnetic field in the ferrite rod when it is desired to trigger the switch into the cut-off state during the radar echo receiving state.

The permanent magnet structures which have been employed for the aforementioned purpose have generally been large, bulky offset ring magnets which have significantly increased the size and weight of the waveguide switch and also the radar equipment in which the switch is used. Additionally, it has been noted that the offset ring magnets were subject to a degradation of performance because of the successive operation of the electromagnetic coil used to activate the switch. The magnetic field produced by these magnets also did not subject the ferrite rod to a uniform magnetic field in the axial direction of the ferrite rod which was necessary for optimum performance.

SUMMARY OF THE INVENTION

It is an object of this invention to provide an improved tetrahedral junction waveguide switch which is more compact, lighter in weight and less bulky than such switches known heretofore.

It is a further object of this invention to provide a tetrahedral junction waveguide switch which is fast acting and which has performance characteristics which will not degrade because of successive switch operations over long periods of time.

It is a still further object of this invention to provide a tetrahedral junction waveguide switch which imposes a minimum drain on an external dc power supply required to operate the switch.

It is an additional object of this invention to provide a tetrahedral junction waveguide switch which is especially suited for use in millimeter wave radar systems and the like. Briefly, the tetrahedral junction waveguide switch of the invention comprises first and second lengths of hollow rectangular waveguide, each of the waveguide lengths being tapered along the longitudinal axis thereof to form an end thereon having a reduced width, and means for mounting the first and second waveguide lengths with the longitudinal axes thereof aligned with each other, the major transverse axes thereof orthogonally disposed with respect to each other and the reduced width ends thereof abutting each other to form an aperture communicating with each of the waveguide lengths. A ferrite rod having tapered ends is mounted in the aperture between the waveguides with the longitudinal axis of the rod aligned with the longitudinal axes of the waveguide lengths. The ferrite rod cooperates with the reduced width ends of the waveguide lengths to permit transmission of millimeter wave electromagnetic wave energy through the aperture from one waveguide length to the other waveguide length when the rod is in a first magnetic state in which a first unidirectional magnetic field is applied along the longitudinal axis of the rod and to cut-off the transmission of the wave energy when the rod is in a second magnetic state in which the first magnetic field is not applied to the rod. A permanent magnet structure is provided for magnetically biasing the ferrite rod into the first magnetic state. The magnet structure has a hollow cylindrical permanent magnet surrounding the waveguide lengths for producing the first magnetic field along the longitudinal axis of the rod and a cladding permanent magnet surrounding a substantial portion of the length of the cylindrical magnet for reducing magnetic flux leakage from the cylindrical magnet and enhancing the first magnetic field. The hollow permanent magnet has the longitudinal axis thereof aligned with the longitudinal axes of the waveguide lengths and is axially magnetized to have a longitudinal magnetic polarity. The cladding permanent magnet is radially magnetized to have a generally radial magnetic polarity transverse to the longitudinal magnetic polarity of the cylindrical magnet and has a constant magnetic potential on its outer exterior surface equal to the magnetic potential on the outer surface of the cylindrical magnet at a circumferential portion between the ends of the cylindrical magnet. Finally, selectively operable helical coil means are provided surrounding the waveguide lengths and coaxial therewith for applying a second unidirectional magnetic field of substantially equal magnitude to the first magnetic field along the longitudinal axis of the rod in opposition to the first magnetic field to thereby place the rod in the second magnetic state.

The nature of the invention and other objects and additional advantages thereof will be more readily understood by those skilled in the art after consideration of the following detailed description taken in conjunction with the accompanying drawings.

DESCRIPTION OF THE PREFERRED EMBODIMENT OF THE INVENTION

Figure 1:
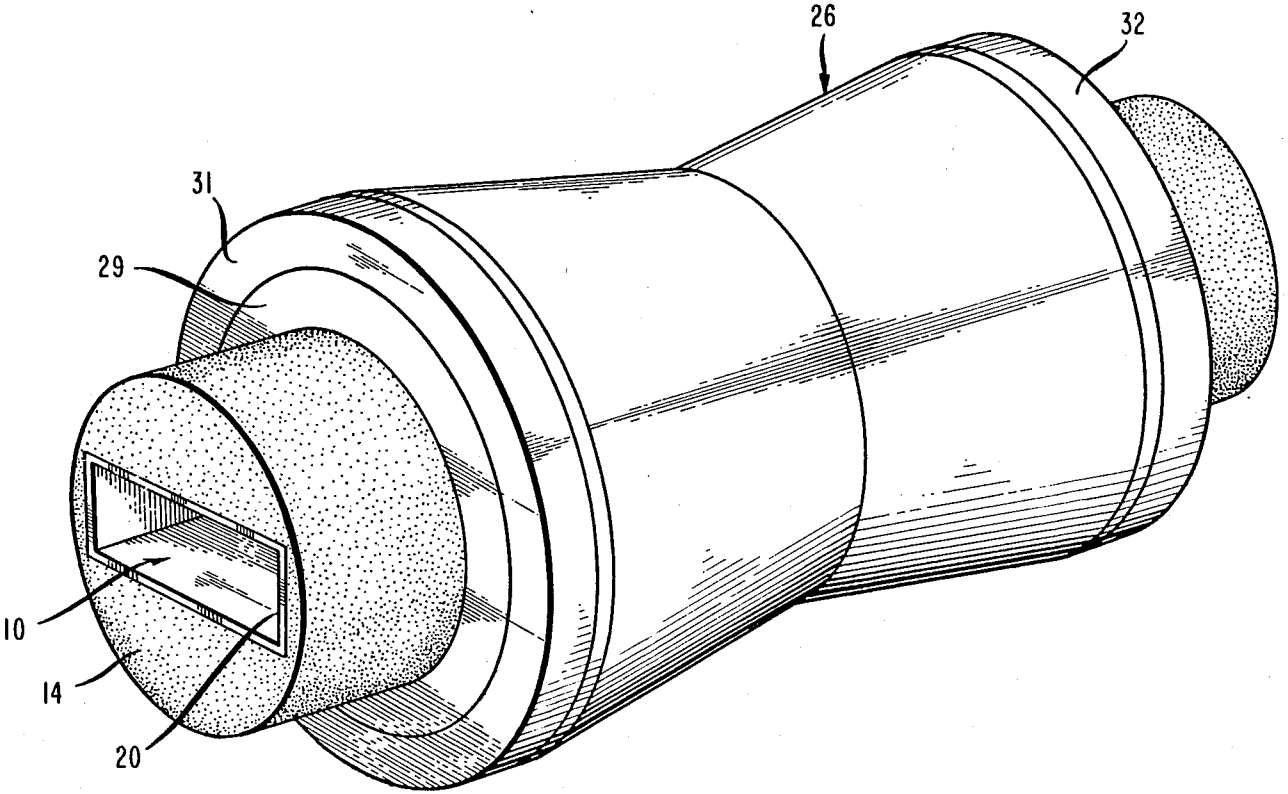
FIG. 1 is a perspective view of the tetrahedral junction waveguide switch of the invention.
Figure 2:
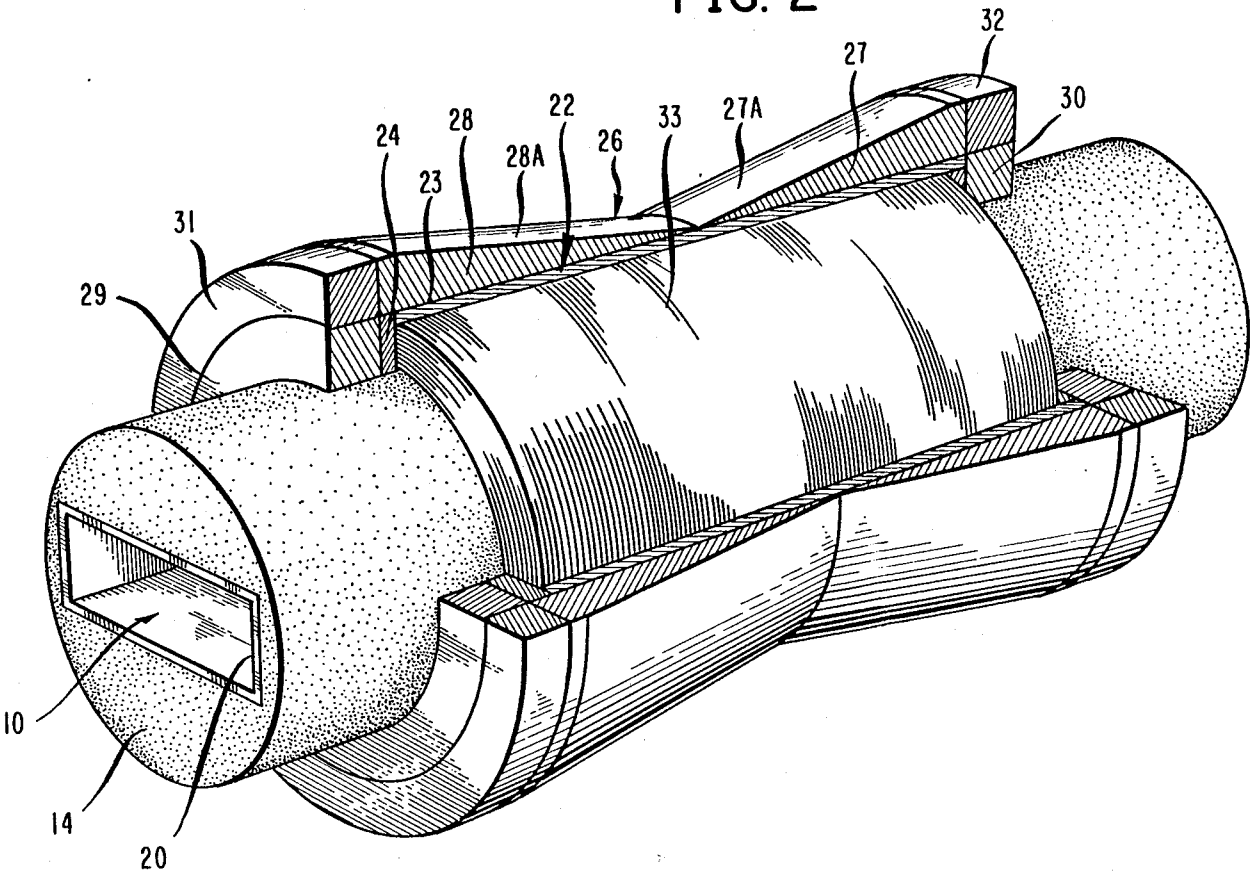
FIG. 2 is a perspective view of the switch of FIG. 1 with the permanent magnet structure of the switch shown in partial section.
Figure 3:
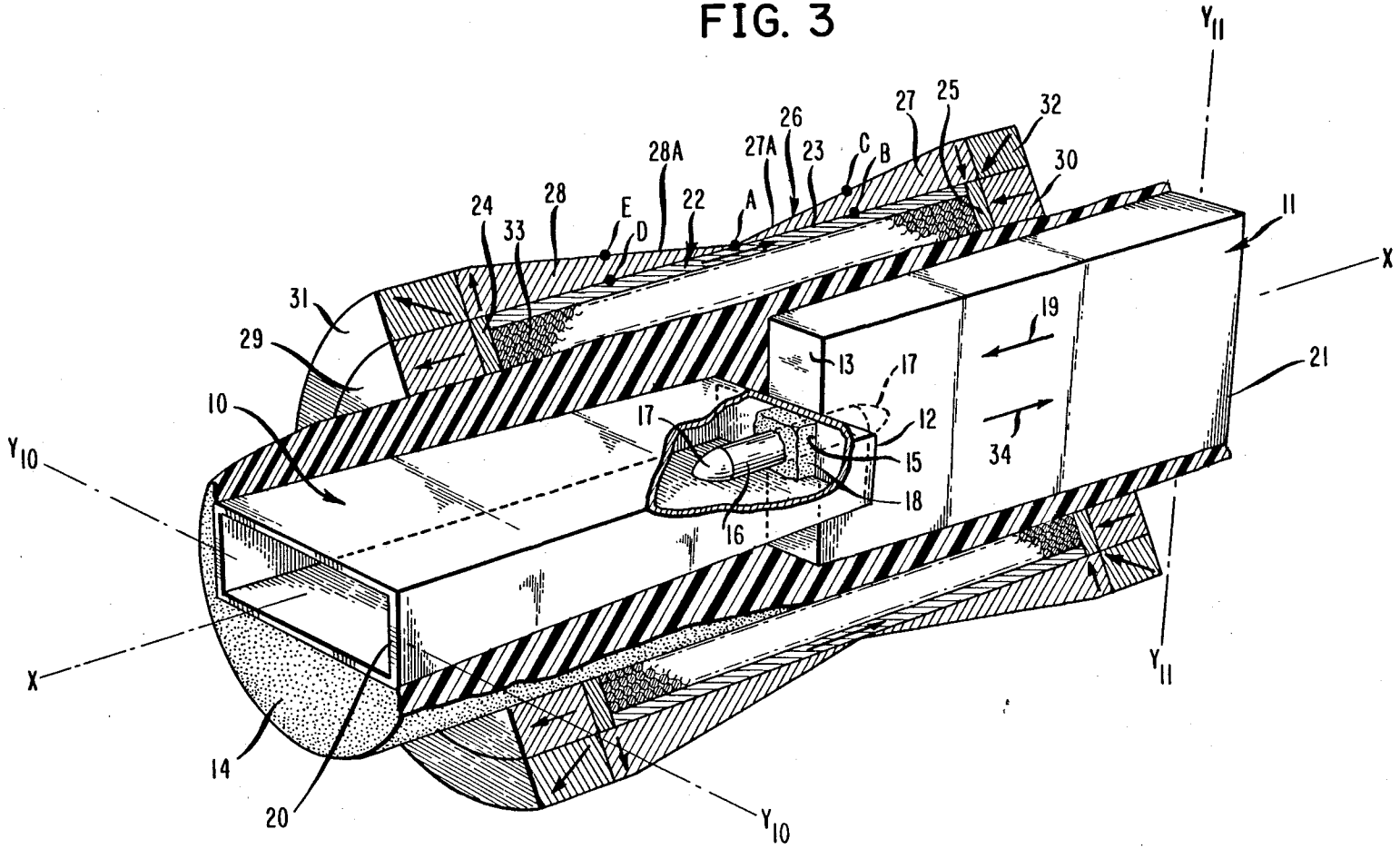
FIG. 3 is a perspective view of the switch of FIG. 1 with the permanent magnet structure, the helical coil means and the switch mounting means shown in full section and with a portion of one of the waveguides lengths broken away to reveal details of construction.

Referring now to FIGS. 1-3 of the drawings, the tetrahedral junction waveguide switch of the invention is shown as comprising a first length, indicated generally as 10, and a second length, indicated generally as 11, of hollow rectangular waveguide. The waveguide lengths are fabricated of copper or other good electrically conductive material. The waveguide lengths 10 and 11 are mounted with their longitudinal axes in alignment as represented by the line X—X in FIG. 3 of the drawings. The waveguide length 10 is tapered along its longitudinal axis to form an end 12 thereon which has a reduced width. The reduced width end 12 is measured in a plane defined by the longitudinal axis X—X and the major transverse axis $Y_{10}$—$Y_{10}$ of the waveguide length 10. In a similar fashion, the waveguide length 11 has a reduced width end 13 which is measured in a plane defined by the longitudinal axis X—X and the major transverse axis $Y_{11}$—$Y_{11}$ of that waveguide length.

A mounting means 14 is provided for mounting the first and second waveguide lengths 10 and 11 with their longitudinal axes X—X in alignment with each other and their major transverse axes $Y_{10}$—$Y_{10}$ and $Y_{11}$—$Y_{11}$, respectively, orthogonally disposed with respect to each other as shown in FIG. 3. The reduced width ends 12 and 13 of the waveguide lengths abut each other to form a substantially square aperture 15 which communicates with each of the waveguide lengths. The mounting means 14 may conveniently comprise a resin potting compound which holds the waveguide lengths 10 and 11 in position and which also serves to support a permanent magnet structure and coil structure to be described hereinafter. Those portions of the waveguide length reduced width ends 12 and 13 which do not form the aperture 15 may be conveniently closed off as illustrated to prevent entry of the potting compound into the waveguide lengths during the potting operation.

A ferrite rod 16 having tapered ends 17 is disposed in a support bead or block 18 which is in turn disposed in the aperture 15. The longitudinal axis of the ferrite rod 16 is aligned with the common longitudinal axes X—X of the two waveguide lengths 10 and 11. The rod 16 is fabricated of a ferrite material such as nickel zinc ferrite, for example, which exhibits gyromagnetic properties when subjected to a magnetic field. The mounting block 18 may be fabricated of a material such as Teflon, for example, which exhibits a low loss transmission characteristic at the millimeter wave frequencies for which the switch is designed. The ends 17 of the ferrite rod 16 are tapered in accordance with well-known techniques so that they cooperate with the reduced width ends 12 and 13 of the waveguide lengths to terminate or cut-off transmission of electromagnetic wave energy through the aperture 15 when the ferrite material of the rod is not subjected to a magnetic field, indicated schematically by the arrow 19, along the longitudinal axis of the rod. Since the major transverse axes $Y_{10}$—$Y_{10}$ and $Y_{11}$—$Y_{11}$ of waveguide lengths 10 and 11, respectively, are orthogonally disposed with respect to each other and because of the aforementioned termination provided by the ferrite rod, electromagnetic wave energy applied to end 20 of waveguide 10 will not pass through the aperture 15 to the output end 21 of waveguide length 11. Similarly, electromagnetic wave energy applied to the end 21 of waveguide length 11 will not pass through the aperture 15 to the output end 20 of waveguide length 10 so that the switch is bidirectional in operation. When a unidirectional magnetic field, such as indicated by the arrow 19, for example, is applied along the longitudinal axis of the rod 16, the gyromagnetic properties of the ferrite material cause the RF electromagnetic wave energy applied to the rod through one of the waveguide lengths to be rotated 90 degrees so that the RF wave signal passes through the aperture 15 to the other waveguide lengths and the switch transmits the energy from the input to the output. It will be noted that this operation occurs regardless of whether the RF electromagnetic wave energy is applied to waveguide end 20 or waveguide end 21 since the switch is truly bidirectional.

The waveguide switch of the invention also provides a permanent magnet structure which magnetically biases the ferrite rod 16 into a first magnetic state in which a first unidirectional magnetic field, as represented by the arrow 19 in FIG. 3, is applied along the longitudinal axis of the rod to keep the switch in the transmission state without the application of any electrical energy. As seen in FIGS. 2 and 3, the permanent magnet structure has a hollow cylindrical permanent magnet, indicated generally as 22, which surrounds the waveguide lengths and which has the longitudinal axis thereof aligned with the longitudinal axes of the waveguide lengths. The cylindrical permanent magnet 22 is axially magnetized to have a longitudinal magnetic polarity as shown by the arrows (unnumbered) in the crosshatched representation of that part in FIG. 3 which produces the aforesaid first magnetic field which is represented by the arrow 19 along the longitudinal axis of the ferrite rod 16. The unnumbered arrows in the cross-hatched representation of cylindrical magnet 22 in FIG. 3 point toward the north pole of the magnet 22. The cylindrical magnet 22 has an exterior surface 23 and ends which abut a pair of annular-shaped, soft iron irises 24 and 25. The opening in each of the annular-shaped irises is sufficiently large to accommodate the potted waveguide lengths 10 and 11 therein.

The permanent magnet structure also includes a cladding permanent magnet, indicated generally as 26, which surrounds the entire length of the cylindrical magnet 22 as shown in FIG. 3. The cladding magnet 26 is employed to reduce magnetic flux leakage from the cylindrical magnet 22 and consequently to enhance the magnetic field 19 produced by the permanent magnet structure along the longitudinal axis of the ferrite rod 16 to thereby improve the performance of the waveguide switch. The cladding magnet 26 may be described as having a double truncated conical shape with juxtaposed truncated ends. The two truncated hollow conical portions are shown in FIG. 3 as 27 and 28. Cladding magnet portion 27 is radially magnetized to have a generally radial magnetic polarity transverse to the longitudinal magnetic polarity of the cylindrical magnet 22. The radial magnetic polarity of portion 27 is shown by the unnumbered arrow in that part which points toward the north pole of that portion. Cladding magnet portion 28 is similarly radially magnetized and has a magnetic polarity shown by the unnumbered arrow in that portion. It will be noted that the radial magnetic polarities of cladding magnet portions 27 and 28 are oppositely disposed so that the arrows in those parts point in opposite directions. The cladding permanent magnet 26 has a constant magnetic potential on its outer exterior surface which is equal to the magnetic potential on the outer surface of the cylindrical magnet 22 at a circumferential portion between the ends of the cylindrical magnet 22. As shown in FIG. 3, the outer exterior surface of cladding magnet 26 consists of exterior surface 27A of portion 27 and exterior surface 28A of portion 28. Accordingly, the magnetic potential of the point identified as C on the exterior surface 27A of cladding magnet portion 27 will be the same as the magnetic potential of the point identified as A on the exterior surface 23 of the cylindrical permanent magnet 22. Similarly, the magnetic potential of the point E on the exterior surface 28A of cladding magnet portion 28 will be the same as the magnetic potential of the aforesaid point A on the exterior surface of the cylindrical magnet 22.

Cladding magnet portion 28 has a radial polarity between the exterior surface 23 of cylindrical magnet 22 and the exterior surface 28A of that portion which will add to or complement the increasing magnetic potential of the cylindrical magnet 22 from the end thereof adjacent iris 25 to the end thereof adjacent iris 24. Cladding magnet portion 27, however, has a radial polarity between the same two surfaces that will subtract from or counter the increasing magnetic potential of the cylindrical magnet 22 from intermediate point or portion A to the end of the cylindrical magnet adjacent iris 25. The radial thickness of cladding magnet portion 28 is chosen to vary while progressing in the axial direction at the same rate that cylindrical magnet 22 increases in potential from the end adjacent iris 24 to the intermediate circumferential point A. Additionally, the radial magnetic potential difference of cladding magnet portion 28 between the surfaces 23 and 28A increases with increasing radial thickness so that this magnet portion will have a maximum radial magnetic potential difference at the end thereof adjacent iris 24. The radial magnetic potential difference of cladding magnet portion 27 between the surfaces 23 and 27A also increases with radial thickness so that this magnet portion will have a maximum radial magnetic potential difference at the end adjacent iris 25 and a zero radial magnetic potential difference at intermediate circumferential portion A which is at its point of zero radial thickness. Accordingly, the magnetic potential drop between point A at the intermediate circumferential portion of the cladding magnet and any point D on the surface 23 extending in a direction toward the end of the cylindrical magnet 22 which is adjacent iris 24 will be equal to the radial magnetic potential rise between point D and point E where point E is the point at which a perpendicular on surface 23 extending radially at point D intersects surface 28A. This will result in a constant magnetic potential along the exterior surface 28A of cladding magnet portion 28 equal to the magnetic potential existing at intermediate circumferential portion A. Similarly, the magnetic potential rise between point A and any point B on the surface 23 of the cylindrical magnet 22 extending in a direction toward the end of the cylindrical magnet adjacent iris 25 will be equal to the radial magnetic potential drop between point B and C, where C is the point at which a perpendicular extending radially from surface 23 at point B intersects surface 27A of the cladding magnet portion 27.

Means are also provided for countering the magnetic potential at the ends of the cylindrical permanent magnet 22. To this end, a first disc-shaped end magnet 29 having an aperture therein is juxtaposed the end cylindrical magnet adjacent iris 24 and a second disc-shaped end magnet 30 having a similar aperture therein is juxtaposed the other end of the cylindrical magnet 22. The apertures in end magnets 29 and 30 are made of a size sufficient to accommodate the potted waveguide lengths 10 and 11 therein. End magnet 29 is magnetized to have an axial polarity as shown by the arrow (unnumbered) in the representation of that part in FIG. 3. End magnet 30 has an axial polarity extending in the same axial direction as end magnet 29 and is represented by a similar arrow in FIG. 3. The permanent magnet structure of the waveguide switch may also include a first ring-shaped edge magnet 31 which is positioned at the intersection of the disc-shaped end magnet 29 and one end of the cladding magnet 26 and a second ring-shaped edge magnet 32 which is positioned at the intersection of the disc-shaped end magnet 30 and the other end of the cladding magnet. Both of the ring-shaped edge magnets 31 and 32 have a generally oblique polarity with respect to the axial polarity of the respective disc-shaped end magnets with which they are associated. The magnetic polarity of each of the edge magnets 31 and 32 is shown by the unnumbered arrows in those parts in FIG. 3 of the drawings. The disc-shaped end magnets 29 and 30 and the ring-shaped edge magnets 31 and 32 serve to further reduce flux leakage from the permanent magnet structure of the switch and consequently also serve to enhance the magnetic field 19 provided in the interior of the switch along the longitudinal axis of the ferrite rod 16 to thereby improve the operating performance of the switch. The cladding arrangement utilized in the waveguide switch of the invention is much lighter in weight and much less bulky than other types of cladding. For a more detailed discussion of the advantages and theory of operation of the cladding arrangement utilized in the permanent magnet structure of the waveguide switch disclosed herein, reference should by made to U.S. Pat. No. 4,647,887 which was issued Mar. 3, 1987 to Herbert A Leupold, one of the inventors of the present application, and which was assigned to the assignee of the present invention.

Referring now to FIGS. 2 and 3 of the drawings, it is seen that a helical coil 33 is disposed within the cylindrical permanent magnet 22 and is arranged to surround the potted waveguide lengths 10 and 11. The helical coil 33 is substantially coaxial with the common longitudinal axis X—X of the waveguide lengths 10 and 11 and when energized with a dc voltage of proper polarity will produce a second unidirectional magnetic field, as represented by the arrow 34 in FIG. 3, along the longitudinal axis of the ferrite rod 16 in a direction which is opposite to the direction of the first magnetic field 19 produced by the permanent magnet structure. When the second magnetic field 34 is of substantially equal magnitude to the first magnetic field 19 the ferrite rod will be placed in the second magnetic state in which no magnetic field is applied to the rod. In this state, the ferrite rod no longer rotates the RF electromagnetic wave signal applied the switch to permit the signal to pass through the aperture and the switch is placed in the cut-off or reflective state. When the current pulse applied to the coil 33 is discontinued, the second magnetic field 34 will be reduced to zero and the ferrite rod 16 will again be magnetically biased by the magnetic field 19 so that RF electromagnetic wave energy will be transmitted through the switch. Because of the high coercive force of the permanent magnet structure of the switch of the invention, the performance of this magnet would not be degraded by repeated energization of the magnetizing coil 33 over long periods of time so that the switch performance will remain at optimum values.

It is believed apparent that many changes could be made in the construction and described uses of the foregoing tetrahedral junction waveguide switch and many seemingly different embodiments of the invention could be constructed without departing from the scope thereof. Accordingly, it is intended that all matter contained in the above description or shown in the accompanying drawings shall be interpreted as illustrative and not in a limiting sense.

What is claimed is:

1. A tetrahedral junction waveguide switch comprising first and second lengths of hollow rectangular waveguide, each of said waveguide lengths being tapered along the longitudinal axis thereof to form an end thereon having a reduced width;

means for mounting said first and second waveguide lengths with the longitudinal axes thereof aligned with each other, the major transverse axes thereof orthogonally disposed with respect to each other and the reduced width ends thereof abutting each other to form an aperture communicating with each of said waveguide lengths;

a ferrite rod having tapered ends mounted in said aperture with the longitudinal axis of the rod aligned with the longitudinal axes of said waveguide lengths, said ferrite rod cooperating with said reduced width ends of said waveguide lengths to permit transmission of millimeter wave electromagnetic wave energy through said aperture from one of said waveguide lengths to the other of said waveguide lengths when said rod is in a first magnetic state in which a first unidirectional magnetic field is applied along the longitudinal axis of the rod and to cut off said transmission of said wave energy when said rod is in a second magnetic state in which said first magnetic field is not applied to said rod;

a permanent magnet structure for magnetically biasing said ferrite rod into said first magnetic state, said magnet structure having a hollow cylindrical permanent magnet surrounding said waveguide lengths and having the longitudinal axis thereof aligned with the longitudinal axes of said waveguide lengths, said cylindrical magnet being axially magnetized to have a longitudinal magnetic polarity to produce said first magnetic field along the longitudinal axis of said rod, and a cladding permanent magnet surrounding a substantial portion of the length of said cylindrical magnet for reducing magnetic flux leakage from said cylindrical magnet and enhancing said first magnetic field, said cladding magnet being radially magnetized to have a generally radial magnetic polarity transverse to the longitudinal magnetic polarity of said cylindrical magnet and having a constant magnetic potential on its outer exterior surface equal to the magnetic potential on the outer surface of said cylindrical magnet at a circumferential portion between the ends of said cylindrical magnet; and selectively operable helical coil means surrounding said waveguide lengths and being coaxial therewith for applying a second unidirectional magnetic field of substantially equal magnitude to said first magnetic field along the longitudinal axis of said rod in opposition to said first magnetic field to place said rod in said second magnetic state.

2. A tetrahedral junction waveguide switch as claimed in claim 1 wherein said selectively operable helical coil means is a helical coil disposed within said hollow cylindrical permanent magnet and extending along the length thereof.

3. A tetrahedral junction waveguide switch as claimed in claim 2 wherein said hollow cylindrical permanent magnet is uniformly magnetized along its longitudinal magnetic polarity and said circumferential portion of said cylindrical magnet is located substantially half way between the ends of said cylindrical magnet.

4. A tetrahedral junction waveguide switch as claimed in claim 3 wherein said cladding permanent magnet is of double truncated conical shape having juxtaposed truncated ends.

5. A tetrahedral junction waveguide switch as claimed in claim 4 further comprising means juxtaposed each of the ends of said cylindrical permanent magnet for countering the magnetic potential thereat.

6. A tetrahedral junction waveguide switch as claimed in claim 5 wherein said means for countering the magnetic potential at each end of said cylindrical permanent magnet comprises a first disc-shaped end magnet having an aperture therein and a generally axial polarity juxtaposed one end of said cylindrical magnet, and a second disc-shaped end magnet having an aperture therein and a generally axial polarity juxtaposed the other end of said cylindrical magnet; and said waveguide lengths are disposed in said apertures.

7. A tetrahedral junction waveguide switch as claimed in claim 6 further comprising a first ring-shaped edge magnet having a generally oblique polarity with respect to the axial polarity of said first disc-shaped end magnet and positioned at the intersection of said first disc-shaped end magnet and said cladding magnet; and a second ring-shaped edge magnet having a generally oblique polarity with respect to the axial polarity of said second disc-shaped end magnet and positioned at the intersection of said second disc-shaped end magnet and said cladding magnet.

* * * * *